US009697761B2

(12) United States Patent
Li

(10) Patent No.: US 9,697,761 B2
(45) Date of Patent: Jul. 4, 2017

(54) CONVERSION METHOD AND CONVERSION SYSTEM OF THREE-COLOR DATA TO FOUR-COLOR DATA

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventor: Man Li, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 27 days.

(21) Appl. No.: 14/888,143

(22) PCT Filed: May 21, 2015

(86) PCT No.: PCT/CN2015/079441
§ 371 (c)(1),
(2) Date: Oct. 30, 2015

(87) PCT Pub. No.: WO2016/155093
PCT Pub. Date: Oct. 6, 2016

(65) Prior Publication Data

US 2017/0039920 A1 Feb. 9, 2017

(30) Foreign Application Priority Data

Mar. 27, 2015 (CN) ..... 2015 1 0142638

(51) Int. Cl.
*G09G 5/02* (2006.01)
*G09G 3/20* (2006.01)
(Continued)

(52) U.S. Cl.
CPC ..... *G09G 3/2003* (2013.01); *G09G 3/32* (2013.01); *G09G 3/3225* (2013.01);
(Continued)

(58) Field of Classification Search
CPC ..... G09G 3/2003; G09G 3/364; G09G 3/3208
See application file for complete search history.

(56) References Cited

U.S. PATENT DOCUMENTS

2009/0046307 A1* 2/2009 Kwak ..... G09G 5/02 358/1.9
2014/0184655 A1* 7/2014 Jang ..... G09G 3/3208 345/690

(Continued)

*Primary Examiner* — Phi Hoang
(74) *Attorney, Agent, or Firm* — Andrew C. Cheng

(57) ABSTRACT

The invention provides a conversion method of three-color data to four-color data, including steps: A) converting input RGB data to intermediate RGBW data according to first, second and third predetermined saturation parameters; B) obtaining first, second and third saturation adjust parameters according to the intermediate RGBW data and standard RGBW data; C) using the first, second and third saturation adjust parameters to respectively adjust the first, second and third predetermined saturation parameters; D) using the first, second and third predetermined saturation parameters after being adjusted to convert the input RGB data to output RGBW data. The invention further includes a conversion system of three-color data to four-color data.

15 Claims, 2 Drawing Sheets

(51) Int. Cl.
*G09G 3/32* (2016.01)
*G09G 3/3225* (2016.01)
*G09G 3/3275* (2016.01)

(52) U.S. Cl.
CPC ... *G09G 3/3275* (2013.01); *G09G 2300/0452* (2013.01); *G09G 2320/0666* (2013.01); *G09G 2340/06* (2013.01)

(56) References Cited

U.S. PATENT DOCUMENTS

2014/0267442 A1* 9/2014 Lin ..... G09G 3/3208
345/690
2014/0333683 A1* 11/2014 Qi ..... G09G 3/3233
345/690

* cited by examiner

CONVERSION METHOD AND CONVERSION SYSTEM OF THREE-COLOR DATA TO FOUR-COLOR DATA

TECHNICAL FIELD

The invention relates to the field of display technology, and particularly to a conversion method and a conversion system of three-color data to four-color data.

DESCRIPTION OF RELATED ART

A display technology of organic light emitting diode (OLED) is a self-luminous display technology with an organic film as an illuminant, its operation principles is that: under the driving of an external voltage, recombining electrons and holes injected by electrodes in an organic material to release energy, and transferring the energy to molecules of an organic light-emitting material, then the molecules of the organic light-emitting material being excited to jump from a ground state to an excited state, and when the excited molecules returning from the excited state to the ground state, such radiative transitions would produce a light-emitting phenomenon.

Different light-emitting materials correspond to different colors of light, commonly used organic light-emitting diodes have three kinds: the first kind is that organic light-emitting diodes only emit a white light, which only have one kind of organic material and the white light emitted from an organic light-emitting diode display device needs a color filter to form Red-Green-Blue (RGB) three colors of light; the second kind is that colored organic light-emitting diodes respectively emit RGB three colors of light, which have three kinds of organic materials and the emitted RGB three colors of light can synthesize a white light; the third kind is that organic light-emitting diodes respectively emit Red-Green-Blue-White (RGBW) four colors of light, which have four kinds of organic materials and the white light can be produced by an individual W sub-pixel. In addition to some advantages of ordinary organic light-emitting diodes such as thin and lightweight, wide viewing angle and high contrast, a RGBW-OLED display device further has W sub-pixels, which not only can realize the displaying with all colors under the condition of without using the color filter, but also can greatly improve display brightness by the individual W sub-pixels and save power consumption.

However, the RGBW-OLED display device has the above-mentioned advantages, but respective sub-pixels of the device have different lifetimes, for example, the lifetime of blue sub-pixel is less than the lifetime of red sub-pixel and the lifetime of red sub-pixel is less than the lifetime of green sub-pixel. Therefore, the lifetime of the RGBW-OLED display device is determined by the lifetime of blue sub-pixel being the shortest lifetime, along with the increase of usage time, the aging of the blue sub-pixel is the most fast and its brightness is gradually reduced, and thus a color shift is occurred on a picture displayed by the RGBW-OLED display device. In addition, the introduction of white (W) sub-pixels can also lead to the decrease of color saturation of picture displayed by the RGBW-OLED display device, and a screen display effect is degraded as a result.

SUMMARY

In order to solve the problems of above-described prior art, an objective of the invention is to provide a conversion method of three-color data to the four-color data, including steps: A) converting input RGB data to intermediate RGBW data according to a first predetermined saturation parameter, a second predetermined saturation parameter and a third predetermined saturation parameter; B) obtaining a first saturation adjust parameter, a second saturation adjust parameter and a third saturation adjust parameter according to the intermediate RGBW data and standard RGBW data; C) using the first saturation adjust parameter, the second saturation adjust parameter and the third saturation adjust parameter to respectively adjust the first predetermined saturation parameter, the second predetermined saturation parameter and the third predetermined saturation parameter; D) using the first predetermined saturation parameter after being adjusted, the second predetermined saturation parameter after being adjusted and the third predetermined saturation parameter after being adjusted to convert the input RGB data to output RGBW data.

In an embodiment, the step of converting input RGB data to intermediate RGBW data according to a first predetermined saturation parameter, a second predetermined saturation parameter and a third predetermined saturation parameter uses the following formula 1, $$W_m=\min(R_i,G_i,B_i)$$

$$R_m=R_i-\beta_1\times W_m$$

$$G_m=G_i-\beta_2\times W_m$$

$$B_m=R_i-\beta_3\times W_m, \qquad \text{[formula 1]}$$

where $R_i$ represents the input R data, $G_i$ represents the input G data, $B_i$ represents the input B data, $W_m$ represents the intermediate W data, $R_m$ represents the intermediate R data, $G_m$ represents the intermediate G data, $B_m$ represents the intermediate B data, $\beta_1$ represents the first predetermined saturation parameter, $\beta_2$ represents the second predetermined saturation parameter, $\beta_3$ represents the third predetermined saturation parameter.

In an embodiment, the first predetermined saturation parameter is a stored previous first predetermined saturation parameter, the second predetermined saturation parameter is a stored previous second predetermined saturation parameter, the third predetermined saturation parameter is a stored previous third predetermined saturation parameter.

In an embodiment, the step of using the first saturation adjust parameter, the second saturation adjust parameter and the third saturation adjust parameter to respectively adjust the first predetermined saturation parameter, the second predetermined saturation parameter and the third predetermined saturation parameter is according to the following formula 2, $$\beta_1'=\beta_1+\Delta\beta_1$$

$$\beta_2'=\beta_2+\Delta\beta_2$$

$$\beta 3'=\beta 3+\Delta\beta 3, \qquad \text{[formula 2]}$$

$\beta_1'$ represents the first predetermined saturation parameter after being adjusted, $\beta_2'$ represents the second predetermined saturation parameter after being adjusted, $\beta_3'$ represents the third predetermined saturation parameter after being adjusted, $\beta_1$ represents the first predetermined saturation parameter, $\beta_2$ represents the second predetermined saturation parameter, $\beta_3$ represents the third predetermined saturation parameter, $\Delta\beta_1$ represents the first saturation adjust parameter, $\Delta\beta_2$ represents the second saturation adjust parameter, $\Delta\beta_3$ represents the third saturation adjust parameter.

In an embodiment, the step of using the first predetermined saturation parameter after being adjusted, the second predetermined saturation parameter after being adjusted and the third predetermined saturation parameter after being adjusted to convert the input RGB data to output RGBW data is according to the following formula 3, $$W_o=\min(R_i,G_i,B_i)$$

$$R_o=R_i-\beta_1'\times W_o$$

$$G_o=G_i-\beta_2'\times W_o$$

$$B_o=R_i-\beta_3'\times W_o, \quad \text{[formula 3]}$$

where $R_i$ represents the input R data, $G_i$ represents the input G data, $B_i$ represents the input B data, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

Another objective of the invention is to provide a conversion system of three-color data to four-color data, including: a first data converting unit configured to convert input RGB data to intermediate RGBW data according to a first predetermined saturation parameter, a second predetermined saturation parameter and a third predetermined saturation parameter; a saturation comparison unit configured to obtain a first saturation adjust parameter, a second saturation adjust parameter and a third saturation adjust parameter according to the intermediate RGBW data and standard RGBW data; a parameter adjustment unit configured to use the first saturation adjust parameter, the second saturation adjust parameter and the third saturation adjust parameter to respectively adjust the first predetermined saturation parameter, the second predetermined saturation parameter and the third predetermined saturation parameter; a second data converting unit configured to use the first predetermined saturation parameter after being adjusted, the second predetermined saturation parameter after being adjusted and the third predetermined saturation parameter after being adjusted to convert the input RGB data to output RGBW data.

In an embodiment, the conversion system further includes: a storage unit configured to store a previous first predetermined saturation parameter, a previous second predetermined saturation parameter and a previous third predetermined saturation parameter; the first predetermined saturation parameter is the stored previous first predetermined saturation parameter, the second predetermined saturation parameter is the stored previous second predetermined saturation parameter, the third predetermined saturation parameter is the stored previous third predetermined saturation parameter.

In an embodiment, the first data converting unit concretely is configured to convert the input RGB data to the intermediate RGBW data according to the first predetermined saturation parameter, the second predetermined saturation parameter and the third predetermined saturation parameter by use of the following formula 1, $$W_m=\min(R_i,G_i,B_i)$$

$$R_m=R_i-\beta_1\times W_m$$

$$G_m=G_i-\beta_2\times W_m$$

$$B_m=R_i-\beta_3\times W_m, \quad \text{[formula 1]}$$

where $R_i$ represents the input R data, $G_i$ represents the input G data, $B_i$ represents the input B data, $W_m$ represents the intermediate W data, $R_m$ represents the intermediate R data, $G_m$ represents the intermediate G data, $B_m$ represents the intermediate B data, $\beta_1$ represents the first predetermined saturation parameter, $\beta_2$ represents the second predetermined saturation parameter, $\beta_3$ represents the third predetermined saturation parameter.

In an embodiment, the parameter adjustment unit concretely is configured to use the first saturation adjust parameter, the second saturation adjust parameter and the third saturation adjust parameter to respectively adjust the first predetermined saturation parameter, the second predetermined saturation parameter and the third predetermined saturation parameter according to the following formula 2, $$\beta_1'=\beta_1+\Delta\beta_1$$

$$\beta_2'=\beta_2+\Delta\beta_2$$

$$\beta_3'=\beta_3+\Delta\beta_3, \quad \text{[formula 2]}$$

where $\beta_1'$ represents the first predetermined saturation parameter after being adjusted, $\beta_2'$ represents the second predetermined saturation parameter after being adjusted, $\beta_3'$ represents the third predetermined saturation parameter after being adjusted, $\beta_1$ represents the first predetermined saturation parameter, $\beta_2$ represents the second predetermined saturation parameter, $\beta_3$ represents the third predetermined saturation parameter, $\Delta\beta_1$ represents the first saturation adjust parameter, $\Delta\beta_2$ represents the second saturation adjust parameter, $\Delta\beta_3$ represents the third saturation adjust parameter.

In an embodiment, the second data converting unit concretely is configured to use the first predetermined saturation parameter after being adjusted, the second predetermined saturation parameter after being adjusted and the third predetermined saturation parameter after being adjusted to convert the input RGB data to the output RGBW data according to the following formula 3, $$W_o=\min(R_i,G_i,B_i)$$

$$R_o=R_i-\beta_1'\times W_o$$

$$G_o=G_i-\beta_2'\times W_o$$

$$B_o=R_i-\beta_3'\times W_o, \quad \text{[formula 3]}$$

where $R_i$ represents the input R data, $G_i$ represents the input G data, $B_i$ represents the input B data, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

The conversion system and the conversion method of three-color data to four-color data of the invention can effectively increase the lifetimes of respective sub-pixels and meanwhile can improve the color saturation of picture displayed by a display device.

BRIEF DESCRIPTION OF THE DRAWINGS

Through the following description with reference to accompanying drawings, the above-described and other aspects, features and advantages of embodiments of the invention will become more clear. In the drawings.

DETAILED DESCRIPTION OF EMBODIMENTS

In the following, embodiments of the invention will be described in detail with reference to accompanying drawings. However, the invention can be implemented in different forms, and the invention cannot be interpreted as being limited to concrete embodiments of the invention illustrated herein. On the contrary, those embodiments provided are to explain the principle and practical application of the invention, so as to make other skills in the art understand various embodiments of the invention and various modifications suitable for specific intended applications.

Figure 1:
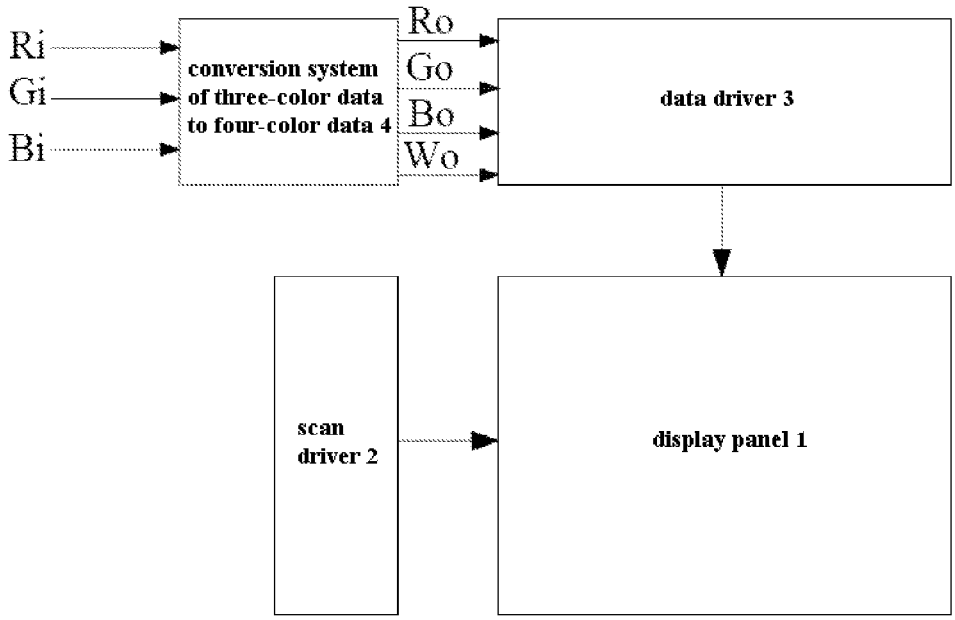
FIG. 1 is a block diagram of a display device according to an embodiment of the invention.
Figure 2:
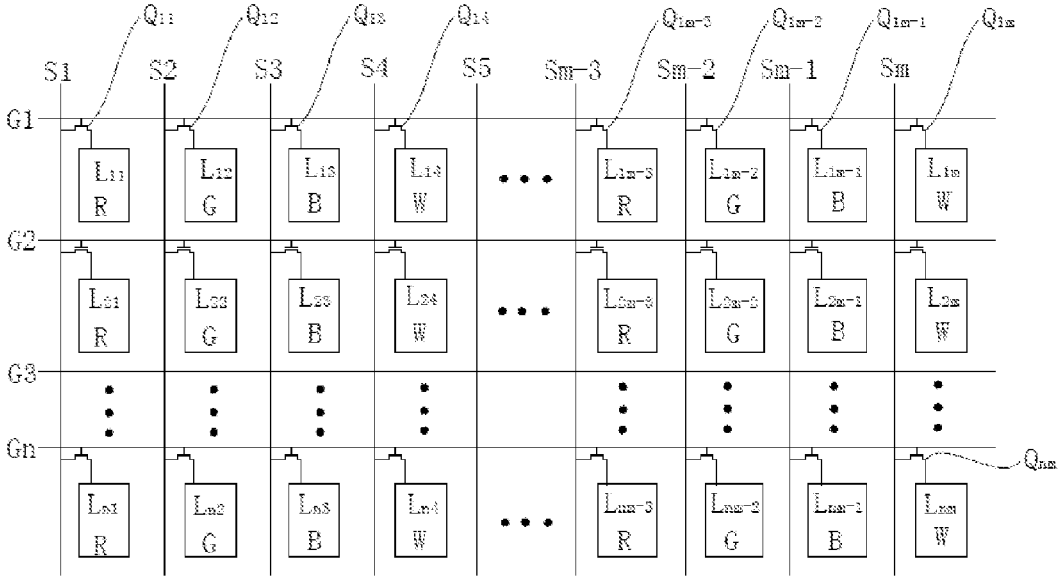
FIG. 2 is a structural view of a display panel according to an embodiment of the invention.

FIG. 1 is a block diagram of a display device according to an embodiment of the invention. FIG. 2 is a structural view of a display panel according to an embodiment of the invention.

Referring to FIG. 1 and FIG. 2, a display device according to an embodiment of the invention is an organic light emitting diode (OLED) display device and includes: a display panel 1, a scan driver 2, a data driver 3, and a conversion system of three-color data to four-color data 4.

The display panel 1 includes: scan lines $G_1$ to $G_n$ extending along a row direction (n is a natural number) and data lines $S_1$ to $S_n$ extending along a column direction (m is a natural number). The scan lines $G_1$ to $G_n$ are all connected to the scan driver 2, the data lines $S_1$ to $S_n$ are all connected to the data driver 3.

A sub-pixel $L_{ij}$ (red (R) sub-pixel, or green (G) sub-pixel, or blue (B) sub-pixel, or white (W) sub-pixel) is disposed in a region defined by the scan line $G_i$, $G_{i+1}$ (i is any one natural number of 1 to n) and the data line $S_j$, $S_{j+1}$ (j is any one natural number of 1 to n). One red (R) sub-pixel, one green (G) sub-pixel, one blue (B) sub-pixel and one white (W) sub-pixel together constitute one pixel.

A thin film transistor (TFT) $Q_{ij}$ is disposed in the vicinity of an intersection of the scan line $G_i$ and the data line $S_j$.

Furthermore, the scan line $G_i$ is connected with a gate of the thin film transistor $Q_{ij}$, the data line $S_j$ is connected with the source of the thin film transistor $Q_{ij}$, and the sub-pixel $L_{ij}$ (red (R) sub-pixel, or green (G) sub-pixel, or blue (B) sub-pixel, or white (W) sub-pixel) is connected with the drain of the thin film transistor $Q_{ij}$.

The scan driver 2 and the data driver 3 are disposed at the periphery of the display panel 1. The conversion system of three-color to four-color 4 converts input RGB data to output RGBW data and further provides the output RGBW data to the data driver 3. Herein, the input RGB data can be provided by such as an external host or a graphics controller (not shown in the drawing).

The data driver 3 receives and processes the output RGBW data provided by the conversion system of three-color data to four-color data 4 to produce analog-type data signals and further provide the analog-type data signals to the data lines $S_1$ to $S_m$. The scan driver 2 sequentially provides multiple scan signals to the scan lines $G_1$ to $G_n$. The display panel 1 displays an image according to the analog-type data signals provided by the data driver 3 and the scan signals provided by the scan driver 2.

Figure 3:
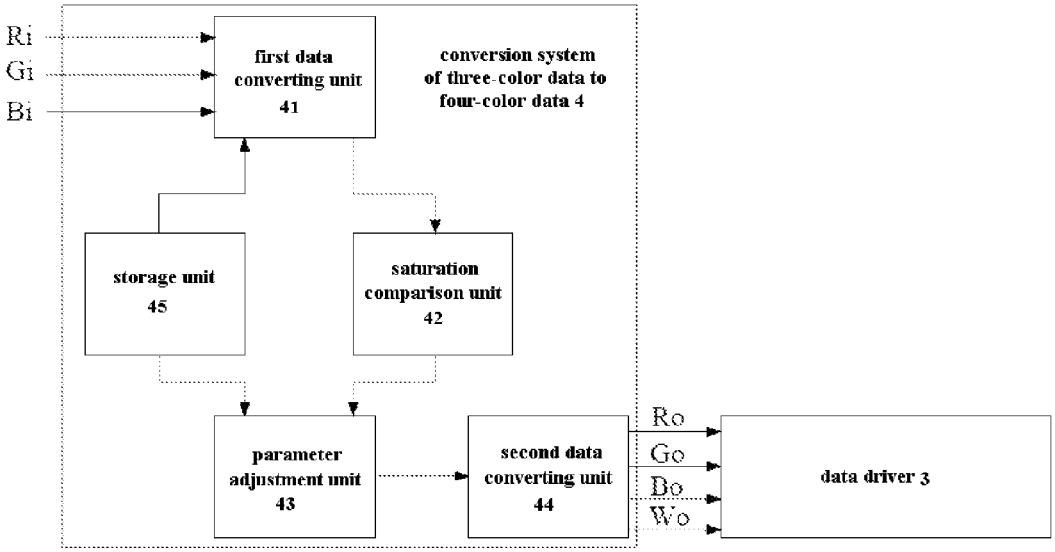
FIG. 3 is a principle block diagram of a conversion system of three-color data to four-color data according to an embodiment of the invention.

FIG. 3 is a principle block diagram of a conversion system of three-color data to four-color data according to an embodiment of the invention.

Referring to FIG. 3, a conversion system of three-color data to four-color data 4 according to an embodiment of the invention includes: a first data converting unit 41, a saturation comparison unit 42, a parameter adjustment unit 43, a second data converting unit 44 and a storage unit 45. It is understood that, the first data converting unit 41, the saturation comparison unit 42, the parameter adjustment unit 43 and the second data converting unit 44 may be software modules stored in a memory and executable by one or more processors. According to other embodiment of the invention, the conversion system 4 can include other additional and/or different units. Similarly, the functions of the above-mentioned units can be combined into a single component.

Concretely, the first data converting unit 41 is configured to convert input RGB data to intermediate RGBW data according to a first predetermined saturation parameter, a second predetermined saturation parameter and a third predetermined saturation parameter received from the storage unit 45.

It is indicated that, the first predetermined saturation parameter is a previous first predetermined saturation parameter stored by the storage unit 45, that is, the first predetermined saturation parameter is a first predetermined saturation parameter after being adjusted during the last boot to display of a display device and then stored by the storage unit 45. The second predetermined saturation parameter is a previous second predetermined saturation parameter stored by the storage unit 45, that is, the second predetermined saturation parameter is a second predetermined saturation parameter after being adjusted during the last boot to display of the display device and then stored by the storage unit 45. The third predetermined saturation parameter is a previous third predetermined saturation parameter stored by the storage unit 45, that is, the third predetermined saturation parameter is a third predetermined saturation parameter after being adjusted during the last boot to display of the display device and then stored by the storage unit 45.

Specifically, the first data converting unit 41 is configured to convert the input RGB data to the intermediate RGBW data by use of the following formula 1 according to the first predetermined saturation parameter, the second predetermined saturation parameter and the third predetermined saturation parameter.

$$W_m=\min(R_i,G_i,B_i)$$

$$R_m=R_i-\beta_1\times W_m$$

$$G_m=G_i-\beta_2\times W_m$$

$$B_m=R_i-\beta_3\times W_m, \qquad \text{[formula 1]}$$

Where $R_i$ represents the input R data, $G_i$ represents the input G data, $B_i$ represents the input B data, $\min(R_i, G_i, B_i)$ represents the minimum value among $R_i$, $G_i$ and $B_i$, $W_m$ represents the intermediate W data, $R_m$ represents the intermediate R data, $G_m$ represents the intermediate G data, $B_m$ represents the intermediate B data, $\beta_1$ represents the first predetermined saturation parameter, $\beta_2$ represents the second predetermined saturation parameter, $\beta_3$ represents the third predetermined saturation parameter.

The saturation comparison unit 42 is configured to obtain a first saturation adjust parameter, a second saturation adjust parameter and a third saturation adjust parameter according to the intermediate RGBW data and standard RGBW data.

Concretely, the saturation comparison unit 42 uses the intermediate RGBW data to calculate an actual saturation value of HSV color space, for example, the saturation comparison unit 42 uses the following formula 2 to calculate the actual saturation value.

$$h = \begin{cases} 0^\circ, \text{ if } \max = \min \\ 60^\circ \times \frac{g-b}{\max - \min} + 0^\circ, \text{ if } \max = r \text{ and } g \geq b \\ 60^\circ \times \frac{g-b}{\max - \min} + 360^\circ, \text{ if } \max = r \text{ and } g < b \\ 60^\circ \times \frac{b-r}{\max - \min} + 120^\circ, \text{ if } \max = g \\ 60^\circ \times \frac{r-g}{\max - \min} + 240^\circ, \text{ if } \max = b \end{cases} \quad \text{[formula 2]}$$

$$s = \begin{cases} 0, \text{ if } \max = 0 \\ \frac{\max - \min}{\max} = 1 - \frac{\min}{\max}, \text{ else} \end{cases}$$

$$v = \max$$

Where r represents the intermediate R data, g represents the intermediate G data, b represents the intermediate B data, max represents the maximum value among r, g and b, min represents the minimum value among r, g and b, h represents a hue value of HSV color space, s represents a saturation value of HSV color space, v represents a brightness value of HSV color space.

The saturation comparison unit 42 further compares the actual saturation value with a predetermined saturation value, and then the saturation comparison unit 42 obtains the first saturation adjust parameter, the second saturation adjust parameter and the third saturation adjust parameter according to the comparison result. The predetermined saturation parameter can be obtained by the above-mentioned formula 2 according to the standard RGBW data.

The parameter adjustment unit 43 is configured to use the first saturation adjust parameter, the second saturation adjust parameter and the third saturation adjust parameter to respectively adjust the first predetermined saturation parameter, the second predetermined saturation parameter and the third predetermined saturation parameter.

In particular, the parameter adjustment unit 43 is configured to use the first saturation adjust parameter, the second saturation adjust parameter and the third saturation adjust parameter to respectively adjust the first predetermined saturation parameter, the second predetermined saturation parameter and the third predetermined saturation parameter according to the following formula 2.

$$\beta_1' = \beta_1 + \Delta\beta_1$$

$$\beta_2' = \beta_2 + \Delta\beta_2$$

$$\beta 3' = \beta 3 + \Delta\beta 3, \quad \text{[formula 2]}$$

Where $\beta_1'$ represents the first predetermined saturation parameter after being adjusted, $\beta_2'$ represents the second predetermined saturation parameter after being adjusted, $\beta_3'$ represents the third predetermined saturation parameter after being adjusted, $\beta_1$ represents the first predetermined saturation parameter, $\beta_2$ represents the second predetermined saturation parameter, $\beta_3$ represents the third predetermined saturation parameter, $\Delta\beta_1$ represents the first saturation adjust parameter, $\Delta\beta_2$ represents the second saturation adjust parameter, $\Delta\beta_3$ represents the third saturation adjust parameter.

Herein, it is indicated that, if the saturation comparison unit 42 determines that the actual saturation value is not less than the predetermined saturation value, the first saturation adjust parameter, the second saturation adjust parameter and the third saturation adjust parameter are zero.

If the saturation comparison unit 42 determines that the actual saturation value is less than the predetermined saturation value, the saturation comparison unit 42 will reduce/decrease the first predetermined saturation parameter and the third predetermined saturation parameter and increase the second predetermined saturation parameter until the actual saturation value is not less than the predetermined saturation value, and then uses reductions (amounts of decrease) of the first predetermined saturation parameter and the third predetermined saturation parameter respectively as the first saturation adjust parameter and the third saturation adjust parameter and uses the amount of increase of the second predetermined saturation parameter as the second saturation adjust parameter. It should be understood that $\Delta\beta_1$ and $\Delta\beta_3$ are negative values and $\Delta\beta_2$ is a positive value at this time.

The second data converting unit 44 is configured to use the first predetermined saturation parameter, the second predetermined saturation parameter and the third predetermined saturation parameter after being adjusted to convert the input RGB data to output RGBW data.

Concretely, the second data converting unit 44 is configured to use the first predetermined saturation parameter, the second predetermined saturation parameter and the third predetermined saturation parameter after being adjusted to convert the input RGB data to output RGBW data according to the following formula 3.

$$Wo = \min(Ri, Gi, Bi)$$

$$Ro = Ri - \beta_1' \times Wo$$

$$Go = Gi - \beta_2' \times Wo$$

$$Bo = Ri - \beta_3' \times Wo \quad \text{[formula 3]}$$

Where $R_i$ represents the input R data, $G_i$ represents the input G data, $B_i$ represents the input B data, $\min(R_i, G_i, B_i)$ represents the minimum value among $R_i$, $G_i$ and $B_i$, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

The storage unit 45 stores the first predetermined saturation parameter, the second predetermined saturation parameter and the third predetermined saturation parameter after being adjusted, as the first predetermined saturation parameter, the second predetermined saturation parameter and the third predetermined saturation parameter during the next boot to display of the display device according to an embodiment of the invention.

Figure 4:
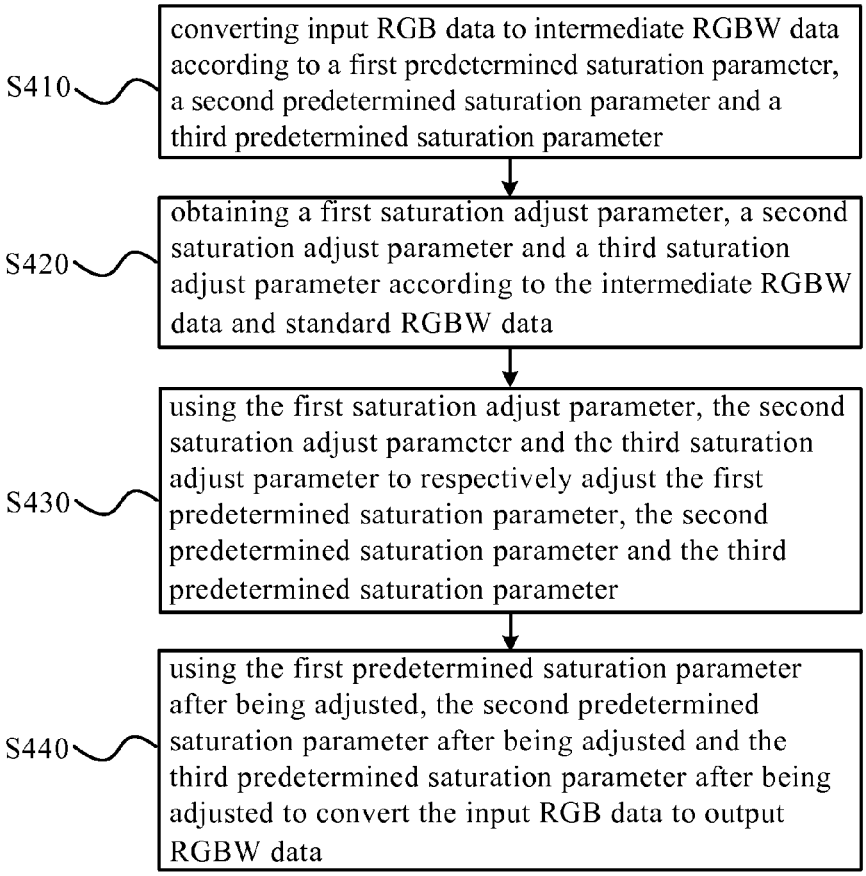
FIG. 4 is a flowchart of a conversion method of three-color data to four-color data according to an embodiment of the invention.

FIG. 4 is a flowchart of a conversion method of three-color data to four-color data according to an embodiment of the invention.

Referring to FIG. 4, in an operation 410, a conversion system of three-color data to four-color data used for converting input RGB data to output RGBW data converts input RGB data to intermediate RGBW data according to a first predetermined saturation parameter, a second predetermined saturation parameter and a third predetermined saturation parameter. Furthermore, the conversion system of three-color data to four-color data can use the above-mentioned formula 1 to convert the input RGB data to the intermediate RGBW data according to the first predetermined saturation parameter, the second predetermined saturation parameter and the third predetermined saturation parameter.

It should be noted that, the first predetermined saturation parameter is a previous first predetermined saturation parameter stored by the conversion system, that is, the first predetermined saturation parameter is a first predetermined saturation parameter after being adjusted during the last boot to display of a display device and then stored by the conversion system. The second predetermined saturation parameter is a previous second predetermined saturation parameter stored by the conversion system, that is, the second predetermined saturation parameter is a second predetermined saturation parameter after being adjusted during the last boot to display of the display device and then stored by the conversion system. The third predetermined saturation parameter is a previous third predetermined saturation parameter stored by the conversion system, that is, the third predetermined saturation parameter is a third predetermined saturation parameter after being adjusted during the last boot to display of the display device and then stored by the conversion system.

In an operation 420, the conversion system of three-color data to four-color data obtains a first saturation adjust parameter, a second saturation adjust parameter and a third saturation adjust parameter according to the intermediate RGBW data and standard RGBW data.

In an operation 430, the conversion system of three-color data to four-color data uses the first saturation adjust parameter, the second saturation adjust parameter and the third saturation adjust parameter to respectively adjust the first predetermined saturation parameter, the second predetermined saturation parameter and the third predetermined saturation parameter. Furthermore, the conversion system of three-color data to four-color data uses the first saturation adjust parameter, the second saturation adjust parameter and the third saturation adjust parameter to respectively adjust the first predetermined saturation parameter, the second predetermined saturation parameter and the third predetermined saturation parameter according to the above-mentioned formula 2.

In an operation 440, the conversion system of three-color data to four-color data uses the first predetermined saturation parameter, the second predetermined saturation parameter and the third predetermined saturation parameter after being adjusted to convert the input RGB data to output RGBW data. Furthermore, the conversion system of three-color data to four-color data uses the first predetermined saturation parameter, the second predetermined saturation parameter and the third predetermined saturation parameter after being adjusted to convert the input RGB data to the output RGBW data according to the above-mentioned formula 3.

In summary, the conversion system and the conversion method of three-color data to four-color data according to embodiments of the invention can effectively increase the lifetimes of respective sub-pixels and meanwhile can improve the color saturation of picture displayed by a display device.

Although the invention has been shown and described with reference to specific embodiments, it should be understood for the skill in the art that without departing from the spirit and scope of the invention defined by claims and equivalents thereof, various changes of forms and details can be made.

What is claimed is:

1. A conversion method of three-color data to four-color data, comprising steps:

A) converting input RGB data to intermediate RGBW data according to a first predetermined saturation parameter, a second predetermined saturation parameter and a third predetermined saturation parameter;

B) obtaining a first saturation adjust parameter, a second saturation adjust parameter and a third saturation adjust parameter according to the intermediate RGBW data and predetermined RGBW data;

C) using the first saturation adjust parameter, the second saturation adjust parameter and the third saturation adjust parameter to respectively adjust the first predetermined saturation parameter, the second predetermined saturation parameter and the third predetermined saturation parameter; and D) using the first predetermined saturation parameter after being adjusted, the second predetermined saturation parameter after being adjusted and the third predetermined saturation parameter after being adjusted to convert the input RGB data to output RGBW data.

2. The conversion method as claimed in claim 1, wherein the step of converting input RGB data to intermediate RGBW data according to a first predetermined saturation parameter, a second predetermined saturation parameter and a third predetermined saturation parameter uses the following formula 1, $$W_m=\min(R_i,G_i,B_i)$$

$$R_m=R_i-\beta_1\times W_m$$

$$G_m=G_i-\beta_2\times W_m$$

$$B_m=R_i-\beta_3\times W_m, \qquad \text{[formula 1]}$$

where Ri represents the input R data, Gi represents the input G data, Bi represents the input B data, Wm represents the intermediate W data, Rm represents the intermediate R data, Gm represents the intermediate G data, Bm represents the intermediate B data, β1 represents the first predetermined saturation parameter, β2 represents the second predetermined saturation parameter, β3 represents the third predetermined saturation parameter.

3. The conversion method as claimed in claim 2, wherein the first predetermined saturation parameter is a stored previous first predetermined saturation parameter, the second predetermined saturation parameter is a stored previous second predetermined saturation parameter, the third predetermined saturation parameter is a stored previous third predetermined saturation parameter.

4. The conversion method as claimed in claim 1, wherein the first predetermined saturation parameter is a stored previous first predetermined saturation parameter, the second predetermined saturation parameter is a stored previous second predetermined saturation parameter, the third predetermined saturation parameter is a stored previous third predetermined saturation parameter.

5. The conversion method as claimed in claim 1, wherein the step of using the first saturation adjust parameter, the second saturation adjust parameter and the third saturation adjust parameter to respectively adjust the first predetermined saturation parameter, the second predetermined saturation parameter and the third predetermined saturation parameter is according to the following formula 2, $$\beta_1'=\beta_1+\Delta\beta_1$$

$$\beta_2'=\beta_2+\Delta\beta_2$$

$$\beta3'=\beta3+\Delta\beta3, \quad \text{[formula 2]}$$

where $\beta_1'$ represents the first predetermined saturation parameter after being adjusted, $\beta_2'$ represents the second predetermined saturation parameter after being adjusted, $\beta_3'$ represents the third predetermined saturation parameter after being adjusted, $\beta_1$ represents the first predetermined saturation parameter, $\beta_2$ represents the second predetermined saturation parameter, $\beta_3$ represents the third predetermined saturation parameter, $\Delta\beta_1$ represents the first saturation adjust parameter, $\Delta\beta_2$ represents the second saturation adjust parameter, $\Delta\beta_3$ represents the third saturation adjust parameter.

6. The conversion method as claimed in claim 5, wherein the step of using the first predetermined saturation parameter after being adjusted, the second predetermined saturation parameter after being adjusted and the third predetermined saturation parameter after being adjusted to convert the input RGB data to output RGBW data is according to the following formula 3, $$Wo=\min(Ri,Gi,Bi)$$

$$Ro=Ri-\beta_1'\times Wo$$

$$Go=Gi-\beta_2'\times Wo$$

$$Bo=Ri-\beta_3'\times Wo, \quad \text{[formula 3]}$$

where $R_i$ represents the input R data, $G_i$ represents the input G data, $B_i$ represents the input B data, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

7. The conversion method as claimed in claim 1, wherein the step of using the first predetermined saturation parameter after being adjusted, the second predetermined saturation parameter after being adjusted and the third predetermined saturation parameter after being adjusted to convert the input RGB data to output RGBW data is according to the following formula 3, $$Wo=\min(Ri,Gi,Bi)$$

$$Ro=Ri-\beta_1'\times Wo$$

$$Go=Gi-\beta_2'\times Wo$$

$$Bo=Ri-\beta_3'\times Wo, \quad \text{[formula 3]}$$

where $R_i$ represents the input R data, $G_i$ represents the input G data, $B_i$ represents the input B data, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

8. A conversion system of three-color data to four-color data, comprising:

a first data converting unit configured to convert input RGB data to intermediate RGBW data according to a first predetermined saturation parameter, a second predetermined saturation parameter and a third predetermined saturation parameter;

a saturation comparison unit configured to obtain a first saturation adjust parameter, a second saturation adjust parameter and a third saturation adjust parameter according to the intermediate RGBW data and predetermined RGBW data;

a parameter adjustment unit configured to use the first saturation adjust parameter, the second saturation adjust parameter and the third saturation adjust parameter to respectively adjust the first predetermined saturation parameter, the second predetermined saturation parameter and the third predetermined saturation parameter; and a second data converting unit configured to use the first predetermined saturation parameter after being adjusted, the second predetermined saturation parameter after being adjusted and the third predetermined saturation parameter after being adjusted to convert the input RGB data to output RGBW data.

9. The conversion system as claimed in claim 8, further comprising: a storage unit configured to store a previous first predetermined saturation parameter, a previous second predetermined saturation parameter and a previous third predetermined saturation parameter;

wherein the first predetermined saturation parameter is the stored previous first predetermined saturation parameter, the second predetermined saturation parameter is the stored previous second predetermined saturation parameter, the third predetermined saturation parameter is the stored previous third predetermined saturation parameter.

10. The conversion system as claimed in claim 9, wherein the first data converting unit concretely is configured to convert the input RGB data to the intermediate RGBW data according to the first predetermined saturation parameter, the second predetermined saturation parameter and the third predetermined saturation parameter by use of the following formula 1, $$W_m=\min(R_i,G_i,B_i)$$

$$R_m=R_i-\beta_1\times W_m$$

$$G_m=G_i-\beta_2\times W_m$$

$$B_m=R_i-\beta_3\times W_m, \quad \text{[formula 1]}$$

where $R_i$ represents the input R data, $G_i$ represents the input G data, $B_i$ represents the input B data, $W_m$ represents the intermediate W data, $R_m$ represents the intermediate R data, $G_m$ represents the intermediate G data, $B_m$ represents the intermediate B data, $\beta_1$ represents the first predetermined saturation parameter, $\beta_2$ represents the second predetermined saturation parameter, $\beta_3$ represents the third predetermined saturation parameter.

11. The conversion system as claimed in claim 10, wherein the parameter adjustment unit concretely is configured to use the first saturation adjust parameter, the second saturation adjust parameter and the third saturation adjust parameter to respectively adjust the first predetermined saturation parameter, the second predetermined saturation parameter and the third predetermined saturation parameter according to the following formula 2, $$\beta_1'=\beta_1+\Delta\beta_1$$

$$\beta_2'=\Delta_2+\Delta\beta_2$$

$$\beta3'=\beta3+\Delta\beta3, \quad \text{[formula 2]}$$

where $\beta_1'$ represents the first predetermined saturation parameter after being adjusted, $\beta_2'$ represents the second predetermined saturation parameter after being adjusted, $\beta_3'$ represents the third predetermined saturation parameter after being adjusted, $\beta_1$ represents the first predetermined saturation parameter, $\beta_2$ represents the second predetermined saturation parameter, $\beta_3$ represents the third predetermined saturation parameter, $\Delta\beta_1$ represents the first saturation tuning parameter, $\Delta\beta_2$ represents the second saturation tuning parameter, $\Delta\beta_3$ represents the third saturation tuning parameter.

12. The conversion system as claimed in claim 11, wherein the second data converting unit concretely is configured to use the first predetermined saturation parameter after being adjusted, the second predetermined saturation parameter after being adjusted and the third predetermined saturation parameter after being adjusted to convert the input RGB data to the output RGBW data according to the following formula 3, $$Wo=\min(Ri,Gi,Bi)$$

$$Ro=Ri-\beta_1'\times Wo$$

$$Go=Gi-\beta_2'\times Wo$$

$$Bo=Ri-\beta_3'\times Wo, \quad \text{[formula 3]}$$

where $R_i$ represents the input R data, $G_i$ represents the input G data, $B_i$ represents the input B data, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

13. The conversion system as claimed in claim 8, wherein the first data converting unit concretely is configured to convert the input RGB data to the intermediate RGBW data according to the first predetermined saturation parameter, the second predetermined saturation parameter and the third predetermined saturation parameter by use of the following formula 1, $$W_m=\min(R_i,G_i,B_i)$$

$$R_m=R_i-\beta_1\times W_m$$

$$G_m=G_i-\beta_2\times W_m$$

$$B_m=R_i-\beta_3\times W_m, \quad \text{[formula 1]}$$

where $R_i$ represents the input R data, $G_i$ represents the input G data, $B_i$ represents the input B data, $W_m$ represents the intermediate W data, $R_m$ represents the intermediate R data, $G_m$ represents the intermediate G data, $B_m$ represents the intermediate B data, $\beta_1$ represents the first predetermined saturation parameter, $\beta_2$ represents the second predetermined saturation parameter, $\beta_3$ represents the third predetermined saturation parameter.

14. The conversion system as claimed in claim 13, wherein the parameter adjustment unit concretely is configured to use the first saturation adjust parameter, the second saturation adjust parameter and the third saturation adjust parameter to respectively adjust the first predetermined saturation parameter, the second predetermined saturation parameter and the third predetermined saturation parameter according to the following formula 2, $$\beta_1'=\beta_1+\Delta\beta_1$$

$$\beta_2'=\beta_2+\Delta\beta_2$$

$$\beta3'\beta3+\Delta\beta3, \quad \text{[formula 2]}$$

where $\beta_1'$ represents the first predetermined saturation parameter after being adjusted, $\beta_2'$ represents the second predetermined saturation parameter after being adjusted, $\beta_3'$ represents the third predetermined saturation parameter after being adjusted, $\beta_1$ represents the first predetermined saturation parameter, $\beta_2$ represents the second predetermined saturation parameter, $\beta_3$ represents the third predetermined saturation parameter, $\Delta\beta_1$ represents the first saturation adjust parameter, $\Delta\beta_2$ represents the second saturation adjust parameter, $\Delta\beta_3$ represents the third saturation adjust parameter.

15. The conversion system as claimed in claim 14, wherein the second data converting unit concretely is configured to use the first predetermined saturation parameter after being adjusted, the second predetermined saturation parameter after being adjusted and the third predetermined saturation parameter after being adjusted to convert the input RGB data to the output RGBW data according to the following formula 3, $$Wo=\min(Ri,Gi,Bi)$$

$$Ro=Ri-\beta_1'\times Wo$$

$$Go=Gi-\beta_2'\times Wo$$

$$Bo=Ri-\beta_3'\times Wo, \quad \text{[formula 3]}$$

where $R_i$ represents the input R data, $G_i$ represents the input G data, $B_i$ represents the input B data, $W_o$ represents the output W data, $R_o$ represents the output R data, $G_o$ represents the output G data, $B_o$ represents the output B data, $\beta_1'$ represents the first predetermined saturation parameter after being adjusted, $\beta_2'$ represents the second predetermined saturation parameter after being adjusted, $\beta_3'$ represents the third predetermined saturation parameter after being adjusted.

* * * * *